US005915544A

United States Patent [19]

Miyazaki

[11] Patent Number: 5,915,544

[45] Date of Patent: Jun. 29, 1999

[54] BREAKER DEVICE

[75] Inventor: Sho Miyazaki, Yokkaichi, Japan

[73] Assignee: Sumitomo Wiring Systems, Ltd., Japan

[21] Appl. No.: 08/989,991

[22] Filed: Dec. 12, 1997

[30] Foreign Application Priority Data

Dec. 16, 1996 [JP] Japan ..... 8-336111

[51] Int. Cl.[6] ..... H01H 1/46; H01R 13/631

[52] U.S. Cl. ..... 200/561; 200/253.1; 200/258; 439/246

[58] Field of Search ..... 439/246, 252, 439/249; 200/258, 253.1, 248, 561, 562, 563, 549, 550

[56] References Cited

U.S. PATENT DOCUMENTS

| | | | |
|---|---|---|---|
| 1,475,128 | 11/1923 | March | 200/550 |
| 2,738,478 | 3/1956 | Hellstern | 439/246 |
| 2,794,086 | 5/1957 | Barrett | 200/248 X |
| 3,374,449 | 3/1968 | Moore et al. | 200/253.1 X |
| 4,668,848 | 5/1987 | Kowalyshen et al. | 200/248 |

FOREIGN PATENT DOCUMENTS

| | | |
|---|---|---|
| 733 631 | 3/1943 | Germany . |
| 27 39 152 | 7/1979 | Germany . |
| 36 09 161 | 10/1986 | Germany . |
| 8-293347 | 11/1996 | Japan . |
| 8-306265 | 11/1996 | Japan . |
| 589934 | 7/1947 | United Kingdom . |
| 1112414 | 5/1968 | United Kingdom . |

*Primary Examiner*—Renee S. Luebke

*Attorney, Agent, or Firm*—Anthony J. Casella; Gerald E. Hespos; Ludomir A. Budzyn

[57] ABSTRACT

Fixed electrodes 40 and terminals 30 are mounted on a casing main body 21 of a breaker device 10 with bolts 50. Each terminal 30 is firmly fixed between the end surface of a spacer 52 fitted on the bolt 50 and a mount base 24 by a fastening force of the bolt 50, and each fixed electrode 40 is pressed against the terminal 30 by an elastic force of a spring washer 52 fitted around the spacer 51 and is mounted such that it can be inclined by deforming the spring washer 52 by a remaining deformation margin. Accordingly, when the fixed electrode 40 is pushed by the movable electrode 44, the inclinations of the fixed electrodes 40 are automatically adjusted to reduce a sliding resistance which acts between the movable electrode 44 and the fixed electrode 40, thereby facilitating the switching operation.

8 Claims, 4 Drawing Sheets

BREAKER DEVICE

BACKGROUND OF THE INVENTION

1. Field of the Invention

The present invention relates to a breaker device.

2. Description of the Prior Art

Breaker devices according to the prior art may comprise two fixed terminals, which are electrically connectable by a bridging element (movable electrode). The bridging element can be positioned in a connection position, where the fixed terminals are connected, and in a disconnection position, where the fixed terminals are disconnected from each other. The bridging element may be coaxially shiftable with respect to the fixed terminals, so as to be arranged in its connection position.

In the above breaker device, if the fixed electrodes are not precisely coaxially positioned, specifically if the fixed electrodes are mounted with their axes displaced from each other due to a variation in molding accuracy of the casing, a sliding resistance between the fixed electrodes and the movable electrode becomes large, requiring a large force to switch the breaker device.

In view of the above problem, an object of the present invention is to provide a breaker device in which a small resistance acts when it is switched.

SUMMARY OF THE INVENTION

According to the invention, there is provided a breaker device, comprising at least one fixed electrode and a movable electrode which are substantially engageable with each other. The fixed electrode is mounted on a base with at least one fastening member electrically connected with, and preferably mounted together with, a terminal of an electric circuit. The movable electrode is moved or movable by a switching operation to be substantially engaged with and disengaged from the fixed electrode. At least one of the fixed electrode and the movable electrode are mounted elastically by an elastic member, so as to be substantially movable or pivotable in a direction arranged at an angle different than 0° or 180° (preferably substantially normal) with respect to a direction of engagement of the movable electrode with the fixed electrode.

Accordingly, when the movable element is displaced toward the fixed electrode when being substantially coaxially displaced with respect to the fixed electrode, by the elastic member a displacement toward the correct radial position, i.e. toward a substantially coaxially arranged relative position, is advantageously possible. In other words, at least one of the electrodes is allowed to be inclined by deforming the elastic member. Here, if the one electrode is inclined during assembly with respect to its proper orientation, the inclination of the at least one electrode (preferably both electrodes) is corrected upon being subjected to a force of the other electrode to align the two electrodes coaxially when the engagement of the other electrode with the one electrode is started by the switching operation. Thus, a small engagement resistance acts while the electrodes are being engaged.

According to a preferred embodiment of the invention, the fastening member comprises a screw shaft to be passed preferably through the terminal and the fixed electrode. A large diameter portion, which has a diameter larger than that of the screw shaft, is passed through a loose insertion hole of the fixed electrode, and preferably to be brought into contact with the terminal.

Preferably, the elastic member is arranged between the head of the screw shaft and the one fixed electrode while leaving a deformation margin.

According to a further preferred embodiment, there is provided a breaker device, comprising a fixed electrode and a movable electrode which are engageable with each other. One of the electrodes is mounted on a base with a fastening member together with a terminal of an electric circuit. The other electrode is moved by a switching operation to be engaged with and disengaged from the one electrode. The fastening member comprises a screw shaft to be passed through the terminal and the one electrode. A large diameter portion which has a diameter larger than that of the screw shaft is passed through a loose insertion hole of the one electrode to be brought into contact with the terminal. An elastic member is arranged between the head of the screw shaft and the one electrode while leaving a deformation margin.

Accordingly, the spacing between the head of the screw shaft and the terminal is fixed to a range of the length of the large diameter portion. The loose insertion hole is formed in a portion of the one electrode through which the large diameter portion is passed, and the elastic member arranged between the one electrode and the head of the screw has a deformation margin. Accordingly, upon being subjected to an external force, the one electrode is allowed to be inclined by deforming the elastic member.

Here, if the one electrode is inclined with respect to its proper orientation when it is assembled, when the engagement of the other electrode with the one electrode is started by the switching operation, the inclination of the one electrode is corrected upon being subjected to a force of the other electrode to coaxially align the two electrodes. Thus, a small engagement resistance acts while the electrodes are being engaged.

In other words, according to this breaker device, the inclination of the one electrode is automatically adjusted to reduce an operational resistance, thereby facilitating the switching operation.

According to a further preferred embodiment, a pair of fixed electrodes are coaxially spaced substantially opposite to each other. The movable electrode is substantially fittable on the fixed electrodes, and is movable in response to a switching operation between an ON state where the movable electrode bridges or electrically connects the fixed electrodes and an OFF state where the movable electrode is fitted only on one fixed electrode.

Preferably, the elastic member comprises a spring washer, which preferably is arranged between particularly the head of the screw shaft and the corresponding fixed electrode, while leaving a deformation margin.

Further preferably, there is provided a breaker device in which a pair of bar-shaped fixed electrodes are coaxially spaced opposite to each other and are mounted on a base with fastening members together with terminals of electric circuits. A tubular movable electrode is fittable on the fixed electrodes and is movable in response to a switching operation between an ON state where the movable electrode bridges the fixed electrodes and an OFF state where the movable electrode is fitted only on one fixed electrode.

Each fastening member comprises a screw shaft to be passed through the corresponding terminal and fixed electrode and a large diameter portion which has a diameter larger than that of the screw shaft and is passed through a loose insertion hole of the fixed electrode to be brought into contact with the terminal. A spring washer is arranged between the head of the screw shaft and the corresponding fixed electrode while leaving a deformation margin.

Accordingly, the spacing between the head of the screw shaft and the terminal is fixed to a range of the length of the large diameter portion. The loose insertion hole is formed in a portion of each fixed electrode through which the corresponding large diameter portion is passed, and each elastic member arranged between the corresponding fixed electrode and the head of the screw has a deformation margin. Accordingly, upon being subjected to an external force, the fixed electrode is allowed to be inclined by deforming the spring washer.

Here, if the fixed electrodes are inclined with respect to their proper orientation when they are assembled, when the engagement of the movable electrode fitted only on one fixed electrode starts being engaged with the other fixed electrode by the switching operation, the inclinations of the fixed electrodes are corrected upon being subjected to a force of the movable electrode to coaxially align the fixed electrodes. Thus, a small engagement resistance acts while the electrodes are being engaged.

In other words, according to this breaker device, the inclinations of the fixed electrodes are automatically adjusted to reduce an operational resistance, thereby facilitating the switching operation.

Still further preferably, at least one of the fixed electrode and the movable electrode comprise a bevelled portion for positioning the fixed electrode and the movable electrode with respect to each other when they are substantially engaged with each other.

Most preferably, the fixed electrode is substantially bar-shaped and the movable electrode is substantially tubular-shaped.

According to a further preferred embodiment, the fastening member comprises a bolt, a spacer and preferably a washer, the spacer, the washer and preferably the elastic member being arranged on the bolt.

Preferably, the fastening member comprises a stepped bolt.

Most preferably, the axial length of the movable electrode is longer than the spacing between the pair of fixed electrodes.

These and other objects, features and advantages of the present invention will become more apparent upon a reading of the following detailed description and accompanying drawings.

DETAILED DESCRIPTION OF THE PREFERRED EMBODIMENTS

Figure 1:
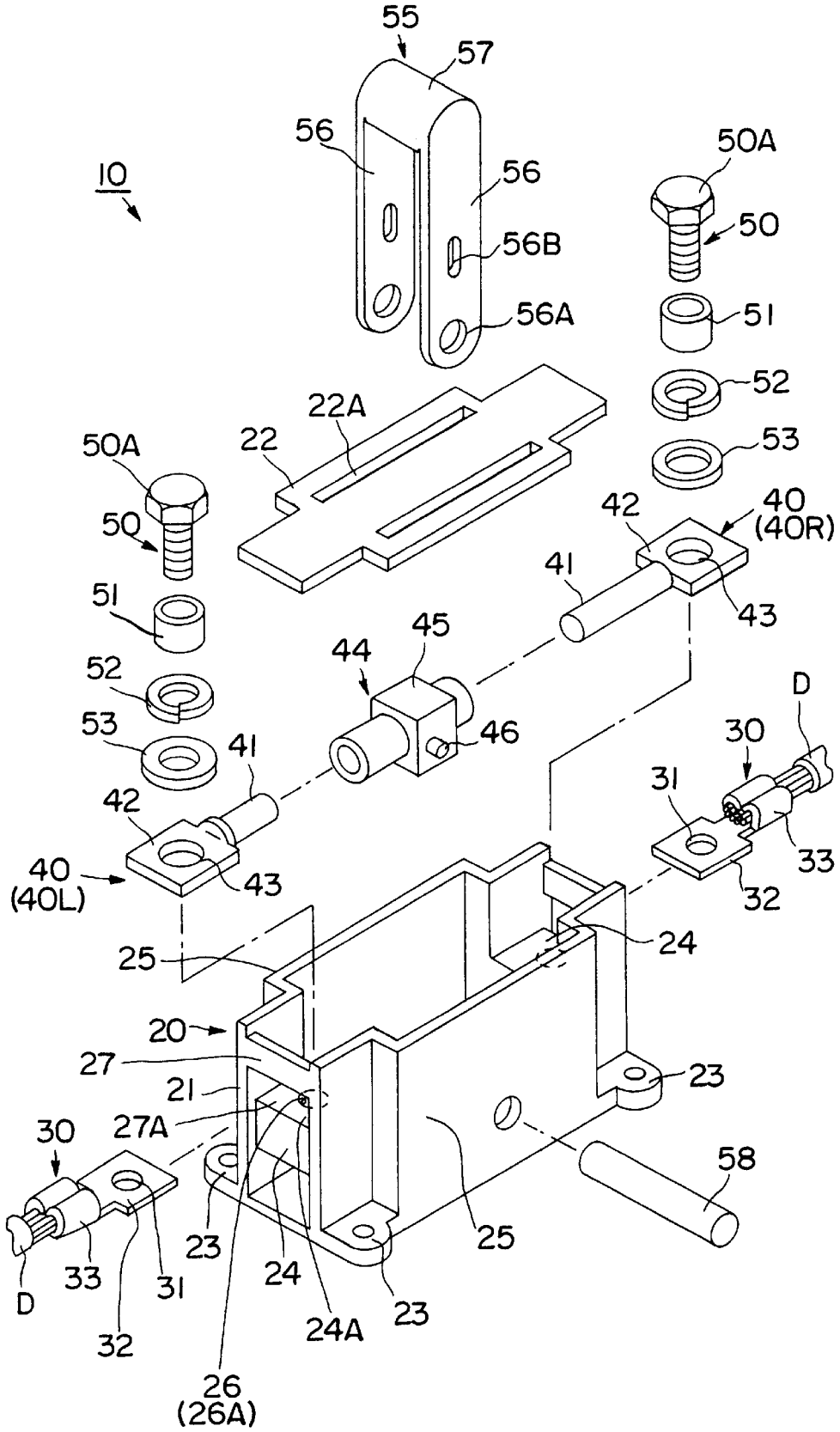
FIG. 1 an exploded perspective view of a breaker device according to one embodiment of the invention.

Hereafter, one embodiment of the invention is described with reference to FIGS. 1 to 3.

A breaker device 10 according to this embodiment is provided with a casing 20 e.g. of a synthetic resin, which has a casing main body 21 which preferably is in the form of a substantially rectangular parallelepiped having an open upper surface. A panel 22 is mountable on the casing main body 21 so as to substantially close the open upper surface. The casing 20 can be fixed to an equipment or the like via mount legs 23 provided at four corners of the casing main body 21. At the opposite ends of the casing main body 21 along its length are provided mount bases 24 for mounting fixed electrodes 40 and terminals 30 to be described later. Each mount base 24 is formed to bridge intermediate portions of side walls 25 of the casing main body 21 with respect to height direction, and a nut 26 is formed or positioned substantially inside the mount base 24 e.g. by insert molding (see FIG. 2). A screw hole 26A of the nut 26 is open upwardly in an upper surface 24A of the mount base 24. On the outside of each mount base 24, a protection wall 27 is formed to bridge the upper ends of the side walls 25. The terminal 30 is insertable to the upper surface 24A of the mount base 24 through a space 27A defined or provided between the protection wall 27 and the mount base 24.

Each terminal 30 includes a preferably substantially rectangular planar portion 32 formed with a bolt hole 31 and a barrel portion 33 which is fastened to the end of a wire D. The width of the rectangular planar portion 32 is substantially equal to the spacing between the side walls 25 on the opposite sides of the mount base 24 so as to substantially prevent the terminal 30 from rotating while the bolt is fastened.

Figure 2:
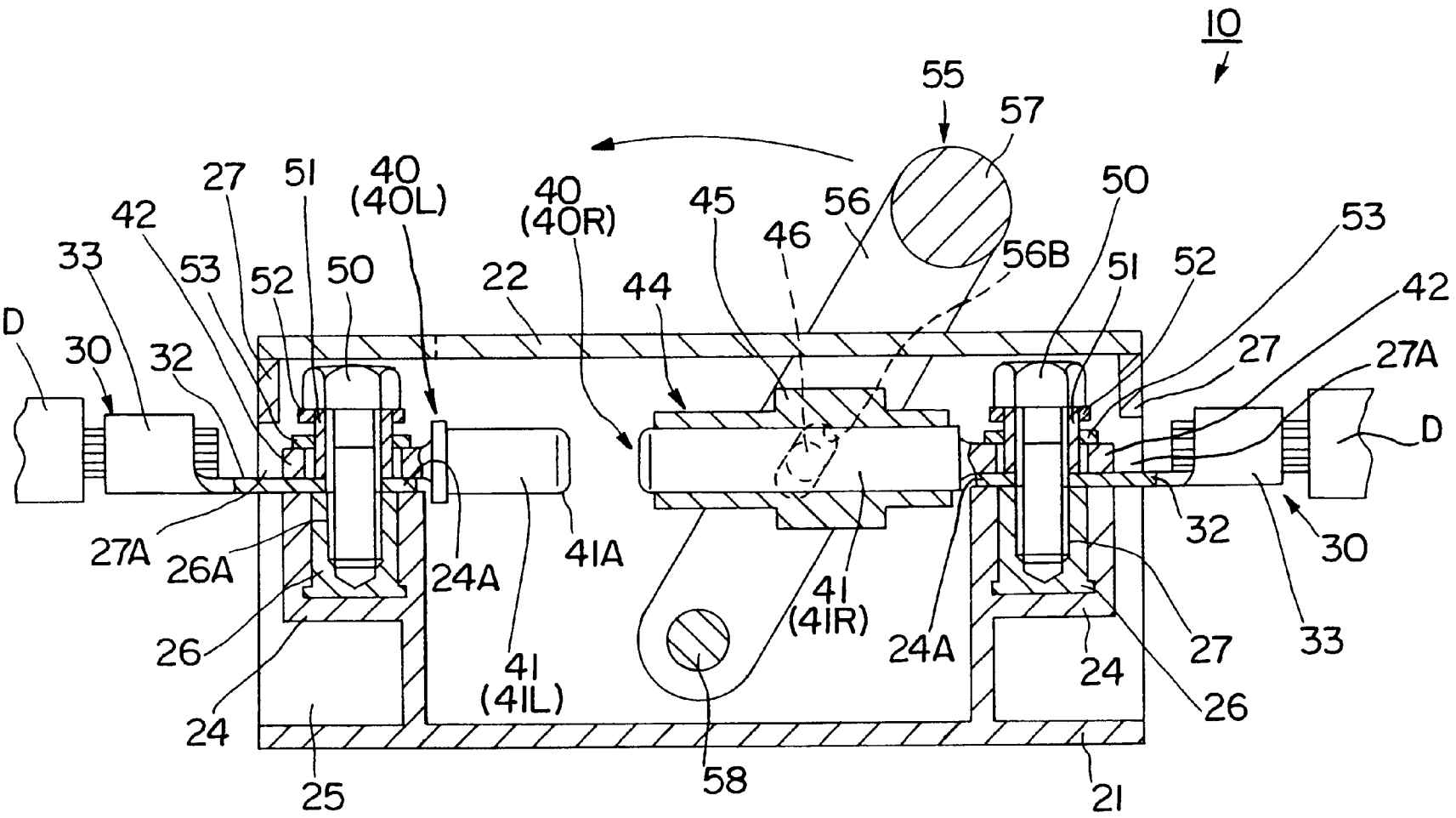
FIG. 2 a side view in section of the breaker device.
Figure 3:
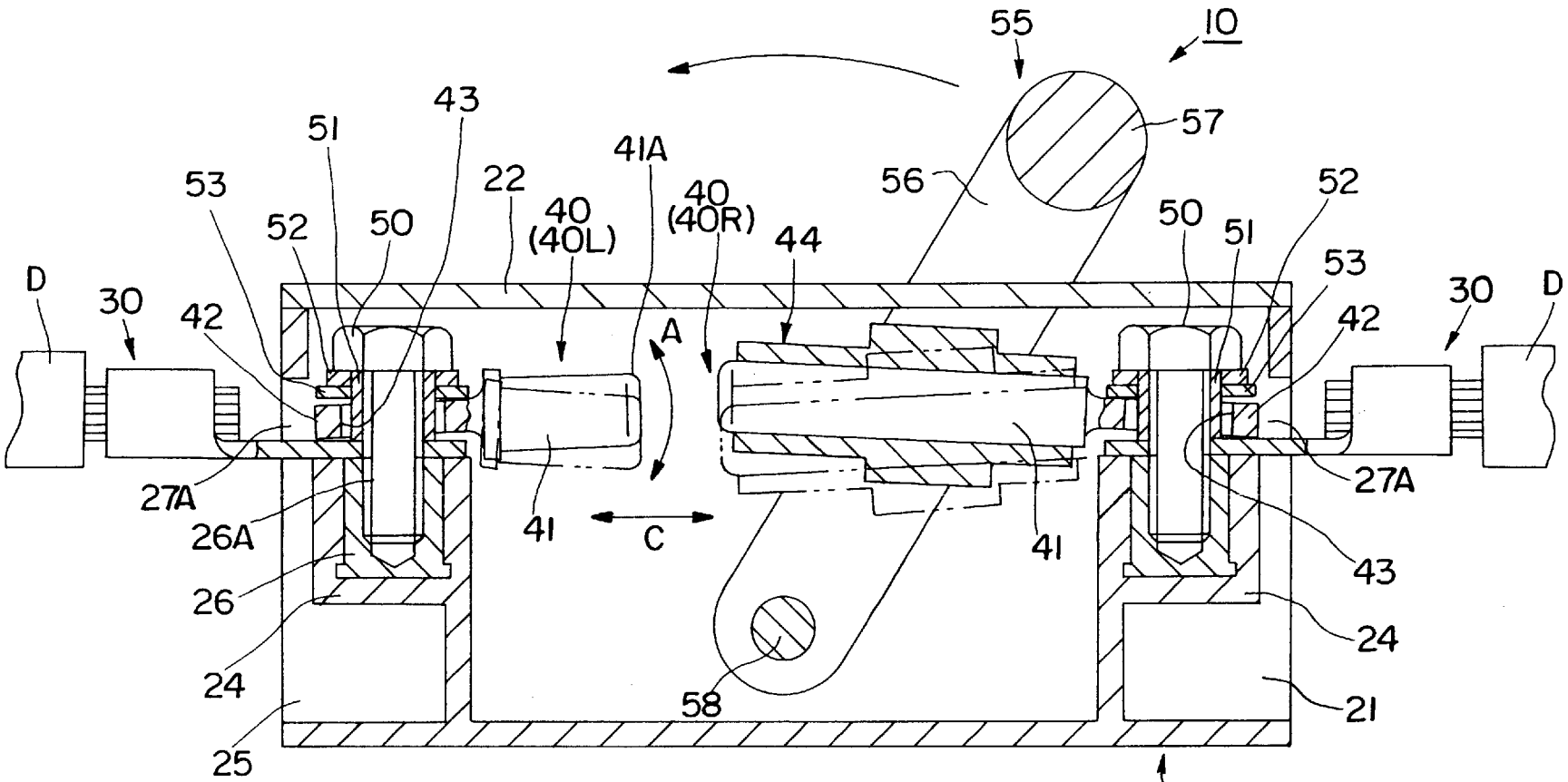
FIG. 3 is a side view in section of the breaker device when fixed electrodes are inclined.

There are a pair of fixed electrodes 40 which are mounted or mountable on the corresponding mount bases 24 together with the terminals 30, and coaxially spaced opposite to each other as shown in FIG. 2. Hereafter, when the left and right fixed electrodes 40 need to be distinguished, the right fixed electrode is identified by 40R and the left fixed electrode is identified by 40L. Each fixed electrode 40 includes a preferably substantially round bar portion 41 fittable or insertable into a movable electrode 44 to be described later. The bar portion 41 is preferably longer in the right fixed electrode 40R than in the left fixed electrode 40L in FIG. 2. A mount portion 42 in the form e.g. of a substantially rectangular flat plate is provided at one end of the bar portion 41 of each fixed electrode 40. A spacer hole 43 is formed in the mount portion 42. This spacer hole 43 corresponds to a "loose insertion hole" according to the invention and has a diameter larger than the outer diameter of a spacer 51 to be described next. The fixed electrode 40 can be inclined with the spacer 51 introduced into the spacer hole 43. Similar to the rectangular planar portion 32 of the terminal 30, the width of the mount portion 42 is substantially equal to the spacing between the side walls 25 at the opposite sides of the mount base 24 so as to substantially prevent the fixed electrode 40 from rotating while a bolt 50 is fastened.

The tubular spacer 51 is fitted on the bolt 50 used to mount the fixed electrode 40, and a spring washer 52 and a substantially flat washer 53 are fitted around the spacer 51 in this order from a bolt head 50A. The diameter of the spacer 51 is set such that the spacer 51 is insertable into the spacer hole 43 of the fixed electrode 40 and is not insertable into the bolt hole 31 of the terminal 30. Accordingly, with the spacer 51 passed through the spacer hole 43 of the fixed electrode 40 and the end surface thereof in contact with the terminal 30, the bolt 50 is screwed to the nut 26 of the mount base 24. The length or thickness of the spacer 51 is set slightly shorter than a sum of the thickness of the mount portion 42 of the fixed electrode 40, the thickness of the flat washer 53 and the natural length of the spring washer 52 (i.e. in its state when no force acts on the spring washer 52). With the bolt 50 fastened, the spring washer 52 is substantially deformed while leaving preferably a deformation margin, e.g. by not flattening the spring washer 52 completely.

The preferably tubular movable electrode 44 is mounted on the round bar portion 41R of the right fixed electrode 40R of FIG. 2 during the assembling. A louver contact or insertion contact is mounted on the inner surface of the movable electrode 44, and a coupling member 45 being preferably insulating, e.g. of a synthetic resin, is mounted on the outer surface thereof. Preferably the louver contact and/or the bar portion 41 has/have bevelled portion or edges 41A so that a coupling or mating of the movable electrode 44 and the bar portion 41 is easily achievable due to a positioning function thereof when the bar portion 41 and the movable electrode 44 are not completely coaxially arranged or aligned. The movable electrode 44 is coupled with a lever 55 to be described next via coupling shafts 46 projecting from the coupling member 45.

The lever 55 is made e.g. of a synthetic resin and has a substantially U-shape as a whole in which a handle portion 57 bridges the upper ends of a pair of arms 56. The lever 55 is rotatably or pivotably mounted on the casing main body 21 by inserting the arms 56 into the casing main body 21 through slits 22A of the panel 22 so as to hold the fixed electrode 40 therebetween and by passing a rotatable or pivotable shaft 58 through holes 56A formed at the leading ends of the arms 56. Oblong holes 56B are formed in intermediate positions of the arms 56. The coupling shafts 46 of the movable electrode 44 are fitted or inserted into the oblong holes 56B so as to enable the translation of the rotational movement of the lever 55 into the substantially sliding movement of the movable electrode 44.

The breaker device 10 is assembled as follows. First, the shorter fixed electrode 40L is secured to the casing main body 21 by fitting the spacer 51 on the bolt 50 and fitting the spring washer 52, the flat washer 53 and the fixed electrode 40L around the spacer 51 toward the bolt head 50A. Thereafter, the terminal 30 is entered into the casing main body 21 through the space 27A, and the bolt hole 31 of the terminal 30 is aligned with the screw hole 26A of the nut 26. The bolt 50 is inserted into the screw hole 26A from above and is fastened by, e.g. a socket wrench. Then, the terminal 30 is firmly fixed between the end surface of the spacer 51 and the mount base 24 by a fastening force of the bolt 50, and the fixed electrode 40L is pressed against the terminal 30 via the flat washer 53 by an elastic force of the spring washer 52, and is mounted such that it can be inclined by deforming the spring washer 52 (see FIG. 3).

Next, the arms 56 of the lever 55 are inserted through the slits 22A of the panel 22 to hold the movable electrode 44 therebetween, and the coupling shafts 46 are engaged with the oblong holes 56B of the arms 56. Similar to the shorter fixed electrode 40L, the spacer 51, the spring washer 52, the flat washer 53 and the fixed electrode 40R are fitted on the bolt 50. In this state, the fixed electrode 40R is fitted into the movable electrode 44. Here, the panel 22 is shifted toward the shorter fixed electrode 40L so that the bolt 50 of the longer fixed electrode 40R is not concealed by the panel 22, and the longer fixed electrode 40L placed on the mount base 24 together with the terminal 30 is fastened with the bolt 50 in the same manner as the shorter fixed electrode 40L is fastened. Finally, the rotatable shaft 58 is passed through the hole 56A of the lever 55 and the panel 22 is pressed or inserted substantially into the upper opening of the casing main body 21, thereby completing the assembling.

The breaker device 10 is switched as follows. In the OFF state of the breaker device 10, the lever 55 is inclined toward the right of FIG. 2 and the movable electrode 44 is mounted only on the fixed electrode 40R as shown in FIG. 2. In order to switch the breaker device 10 to the ON state, the lever 55 is rotated counterclockwise of FIG. 2 by hand or the like. Then, the movable electrode 44 moves toward the left along the fixed electrode 40R, and the end thereof is fitted on the fixed electrode 40L at the opposite side, thereby bridging the fixed electrodes 40R, 40L. As a result, the wires D connected with the respective terminals 30 are electrically connected with each other.

If the fixed electrodes 40R, 40L are not precisely coaxially arranged, i.e. the axes thereof are not linearly aligned, when the engagement of the movable electrode 44 with the left fixed electrode 40L is started by the switching operation, the inclinations of the fixed electrodes 40 are corrected by being subjected to a force of the movable electrode 44 in a direction A arranged at an angle different from 0° or 180° with respect to a coupling direction C of the movable electrode 44 with the fixed electrode 40, to coaxially align the fixed electrodes. As a result, a small resistance acts while the fixed and movable electrodes are being engaged. Additionally the bevelled portions 41A of the bar portion 41 and/or of the louver contact of the movable electrode 44 facilitate an engagement by facilitating the aligning function in the direction A.

Specifically, according to the breaker device 10 of this embodiment, the inclinations of the fixed electrodes are automatically adjusted so that an operational resistance becomes smaller, thereby facilitating the switching operation.

Figure 4:
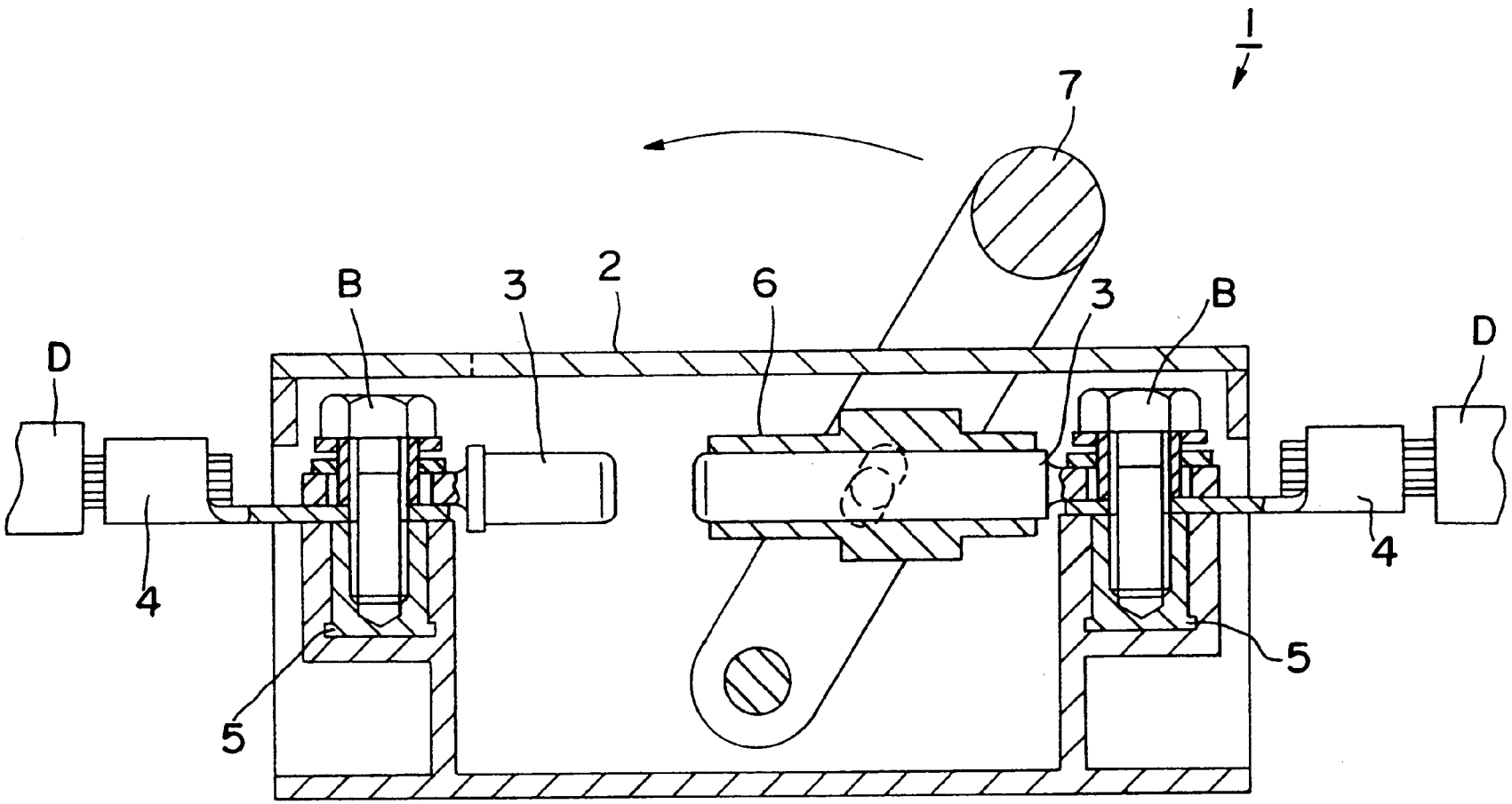
FIG. 4 a side view in section of a further breaker device.

Hereafter, a further breaker device is described with reference to FIG. 4.

In a casing 2 of this breaker device 1, a pair of fixed electrodes 3 in the form of round bars are coaxially spaced opposite to each other and are fastened to terminals 4 which are connected with ends of wires D. The terminals 4 are held movably in the casing 2 by bolts B connected to nuts 5 formed on the casing 2 by insert molding B. A tubular movable electrode 6 mountable on the fixed electrodes 3 is slidably supported by the fixed electrodes 3. The state of the breaker device 1 is switched by pivoting a lever 7 between an ON state where the movable electrode 6 is mounted on both fixed electrodes 3 and an OFF state where the movable electrode is mounted only on one fixed electrode 3.

The present invention is not limited to the described and illustrated embodiment, but the following embodiments are also embraced by the technical scope of the present invention as defined in the claims. Further, a variety of other changes can be made without departing from the scope and spirit of the invention as defined in the claims.

Although the electrodes 40 in the form of round bars are secured to the casing main body 21 and the tubular electrode 44 is made movable in the foregoing embodiment, the present invention is also applicable to a breaker device in which tubular electrodes are fixed and an electrode in the form of a round bar is made movable.

Instead of the spacer and the bolt of the foregoing embodiment, a stepped bolt may be used.

According to the preceding embodiments the bar portion 41 is substantially round and the movable electrode 44 is substantially tubular. However any shape or configuration of the mating bar portion 41 and the movable electrode 44 is possible.

What is claimed is:

1. A breaker device comprising:

at least one fixed electrode having a loose insertion hole;

a movable electrode that is movable by a switching operation along an engagement axis for selective engagement with and disengagement from the fixed electrode; and a fastening member for electrically connecting the fixed electrode with a terminal of an electric circuit, the fastening member comprising a tubular spacer extending through the loose insertion hole of the fixed electrode and into contact with the terminal, a bolt having a screw shaft with a diameter smaller than the tubular spacer, the screw shaft being passed loosely through the tubular spacer and through the terminal, and an elastic member disposed between the bolt and the fixed electrode, the fastening member enabling the fixed electrode to be movable at an angle different than 0° and 180° with respect to the engagement axis for aligning the electrodes during the switching operation and thereby reducing engagement resistance.

2. A breaker device according to claim 1, wherein the fastening member further comprises a washer arranged on the bolt between the elastic member and the fixed electrode.

3. A breaker device according to claim 1, wherein the bolt has an enlarged head, the elastic member being arranged between the head of the bolt and the fixed electrode while leaving a deformation margin.

4. A breaker device according to claim 3, wherein the elastic member comprises a spring washer

5. A breaker device according to claim 1, wherein the at least one fixed electrode comprises first and second fixed electrodes that are spaced substantially coaxially opposite to each other, the movable electrode being fittable on the fixed electrodes and being movable in response to the switching operation between an ON state where the movable electrode bridges the fixed electrodes and an OFF state where the movable electrode is fitted only on said first fixed electrode.

6. A breaker device according to claim 5, wherein at least one of the second fixed electrode and the movable electrode comprise a bevelled portion for aligning the second fixed electrode and the movable electrode with respect to each other during the switching operation.

7. A breaker device according to claim 6, wherein each said fixed electrode is bar-shaped and the movable electrode is tubular-shaped.

8. A breaker device according to claim 5, wherein the movable electrode has an axial length that is longer than the spacing between the fixed electrodes.

* * * * *